US008123463B2

(12) United States Patent
Kray et al.

(10) Patent No.: US 8,123,463 B2
(45) Date of Patent: Feb. 28, 2012

(54) METHOD AND SYSTEM FOR MANUFACTURING A BLADE

(75) Inventors: Nicholas Joseph Kray, Cincinnati, OH (US); Tod Davis, Hamilton, OH (US); Christopher Lee McAfee, Fairfield, OH (US); Michael John Franks, Cincinnati, OH (US); Kevin Lee Kirkeng, Milford, OH (US); David Crall, Loveland, OH (US)

(73) Assignee: General Electric Company, Schenectady, NY (US)

( * ) Notice: Subject to any disclaimer, the term of this patent is extended or adjusted under 35 U.S.C. 154(b) by 881 days.

(21) Appl. No.: 12/183,805

(22) Filed: Jul. 31, 2008

(65) Prior Publication Data

US 2010/0028594 A1 Feb. 4, 2010

(51) Int. Cl.
*F01D 5/18* (2006.01)

(52) U.S. Cl. ..... 415/115; 415/116; 416/229 A; 416/230; 416/239; 416/241 R; 156/175; 156/180; 156/195; 29/889.6; 29/889.71

(58) Field of Classification Search ..... 415/115, 415/116; 416/219 R, 229 A, 229 R, 230, 416/232, 239, 241 A, 241 R; 29/889.6, 889.71; 156/175, 180, 195; 425/389, 403; 428/377, 428/398

See application file for complete search history.

(56) References Cited

U.S. PATENT DOCUMENTS

| | | | | |
|---|---|---|---|---|
| 3,600,103 | A | 8/1971 | Gray et al. | |
| 3,752,600 | A * | 8/1973 | Walsh et al. | 416/219 R |
| 3,903,578 | A | 9/1975 | Rothman | |
| 3,942,231 | A | 3/1976 | Whitaker | |
| 4,083,656 | A | 4/1978 | Braswell et al. | |
| 4,381,960 | A * | 5/1983 | Pinter et al. | 156/175 |
| 4,472,866 | A * | 9/1984 | Moracz et al. | 29/889.6 |
| 4,583,274 | A * | 4/1986 | Moracz et al. | 29/889.71 |
| 4,589,176 | A | 5/1986 | Rosman et al. | |
| 4,976,587 | A * | 12/1990 | Johnston et al. | 416/230 |
| 5,292,231 | A * | 3/1994 | Lauzeille | 416/229 A |
| 5,573,377 | A * | 11/1996 | Bond et al. | 416/229 A |
| 6,290,466 | B1 * | 9/2001 | Ravenhall et al. | 416/229 A |
| 6,290,895 | B1 * | 9/2001 | Wang et al. | 264/510 |
| 6,341,942 | B1 * | 1/2002 | Chou et al. | 416/228 |
| 7,429,166 | B2 | 9/2008 | Mitchell | |
| 2005/0260870 | A1 * | 11/2005 | Marshall et al. | 439/67 |
| 2011/0129348 | A1 * | 6/2011 | Parkin et al. | 416/230 |
| 2011/0182743 | A1 * | 7/2011 | Naik | 416/230 |

* cited by examiner

*Primary Examiner* — Michael Lebentritt
(74) *Attorney, Agent, or Firm* — David J. Clement, Esq.; Armstrong Teasdale LLP

(57) ABSTRACT

A method of manufacturing a blade is provided. The method includes providing a plurality of first plies, each of the first plies sized to extend substantially the length of a span of the blade and providing a plurality of second plies, each of the second plies sized to extend only partially the length of the span of the blade. The method also includes layering the plurality of first plies and the plurality of second plies in a mold such that the plurality of second plies is interspersed throughout the plurality of first plies to spread apart the plurality of first plies to facilitate increasing a cross-sectional area of the blade and bonding the plurality of first plies to the plurality of second plies to facilitate forming a structural core of the blade.

20 Claims, 5 Drawing Sheets

METHOD AND SYSTEM FOR MANUFACTURING A BLADE

BACKGROUND OF THE INVENTION

The field of this disclosure relates generally to blades and, more particularly, to a method and a system for manufacturing blades.

Many known gas turbine engine compressors include rotor blades that extend radially outwardly from a disk or spool to a blade tip to define an airflow path through the engine. In operation, air flowing through the engine imparts significant mechanical stresses (e.g., chordwise bending stresses) on the blades, causing the blades to crack or otherwise fail over time. As such, at least some known rotor blades are formed from plies of composite material that internally span the length of the blade to facilitate adding structural support and longevity to the blade.

At least some known compressor rotor blades have a larger cross-sectional area proximate the root of the blade to form a dovetail for coupling the blade to the disk or spool. To form the larger cross-sectional area, supplemental composite plies are often inserted near the root of the blade to spread apart the composite plies that span the blade. In many known rotor blades, the supplemental plies create zones of weakness throughout the dovetail, increasing the likelihood that the blade will fail under the thermal and/or mechanical stresses imparted on the blade during operation of the gas turbine engine.

BRIEF DESCRIPTION OF THE INVENTION

In one aspect, a method of manufacturing a blade is provided. The method includes providing a plurality of first plies, each of the first plies sized to extend substantially the length of a span of the blade and providing a plurality of second plies, each of the second plies sized to extend only partially the length of the span of the blade. The method also includes layering the plurality of first plies and the plurality of second plies in a mold such that the plurality of second plies is interspersed throughout the plurality of first plies to spread apart the plurality of first plies to facilitate increasing a cross-sectional area of the blade and bonding the plurality of first plies to the plurality of second plies to facilitate forming a structural core of the blade.

In another aspect, a system for manufacturing a blade is provided. The system includes a mold and a plurality of first plies, each of the first plies sized to extend substantially the length of a span of the blade. The system also includes a plurality of second plies, each of the second plies sized to extend only partially the length of the span of the blade, the plurality of first plies layered with the plurality of second plies in the mold such that the plurality of second plies is interspersed throughout the plurality of first plies to spread apart the plurality of first plies to facilitate increasing a cross-sectional area of the blade.

In another aspect, a blade is provided. The blade includes a plurality of first plies, each of the first plies sized to extend substantially the length of a span of the blade. The blade also includes a plurality of second plies, each of the second plies sized to extend only partially the length of the span of the blade, the plurality of first plies layered with the plurality of second plies such that the plurality of second plies is interspersed throughout the plurality of first plies to spread apart the plurality of first plies to facilitate increasing a cross-sectional area of the blade, the plurality of first plies bonded to the plurality of second plies.

DETAILED DESCRIPTION OF THE INVENTION

The following detailed description illustrates exemplary methods and a system for manufacturing blades by way of example and not by way of limitation. The description enables one of ordinary skill in the art to make and use the disclosure, and the description describes several embodiments, adaptations, variations, alternatives, and uses of the disclosure, including what is presently believed to be the best mode of carrying out the disclosure. The disclosure is described herein as being applied to a preferred embodiment, namely, methods and a system for manufacturing blades. However, it is contemplated that this disclosure has general application to manufacturing components in a broad range of systems and in a variety of industrial and/or consumer applications.

Figure 1:
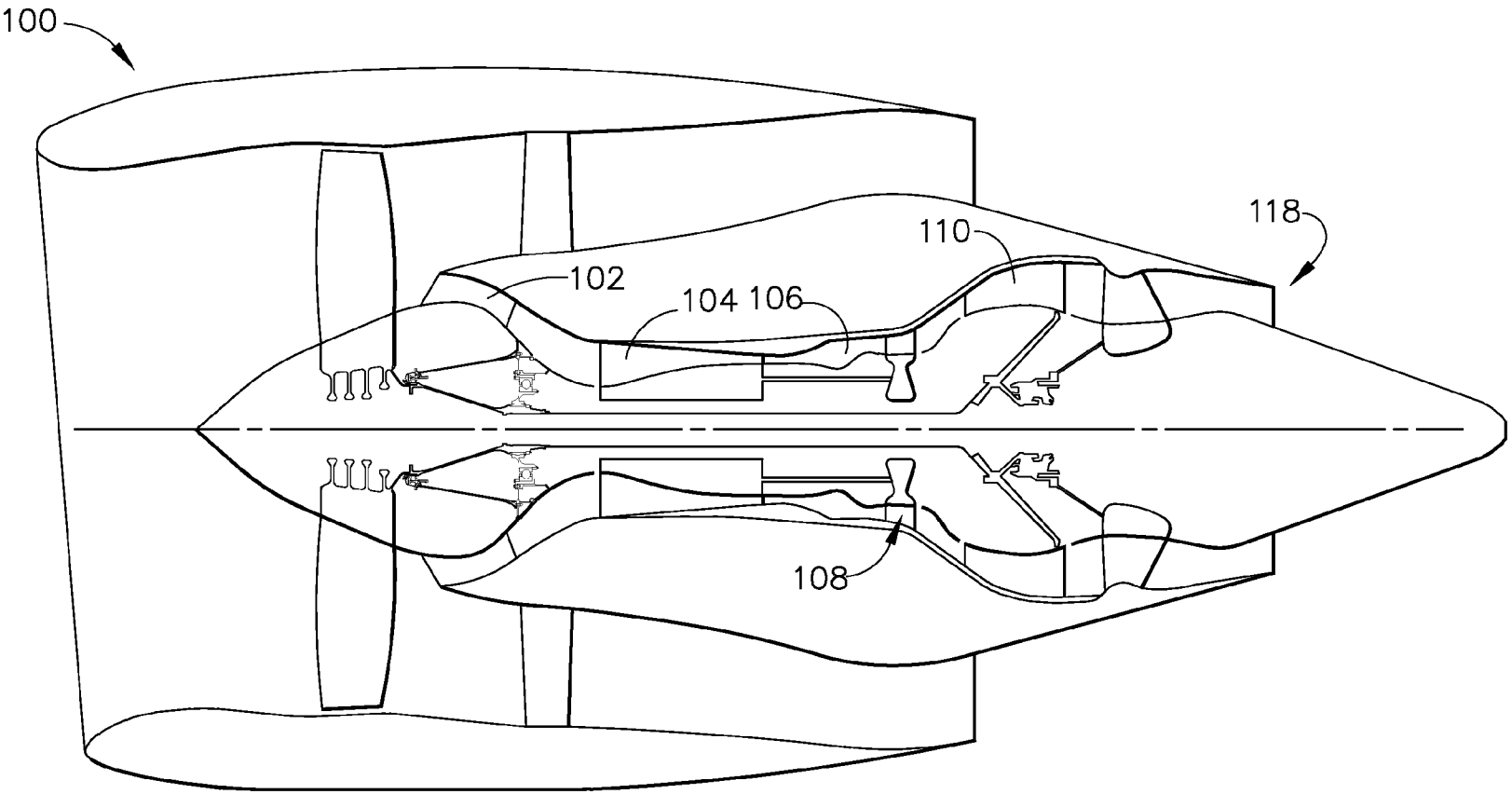
FIG. 1 is a schematic illustration of a gas turbine engine.

FIG. 1 is a schematic illustration of a gas turbine engine 100 including a fan assembly 102, a high pressure compressor 104, and a combustor 106. Engine 100 also includes a high pressure turbine 108 and a low pressure turbine 110. In operation, air flows through fan assembly 102 and compressed air is supplied from fan assembly 102 to high pressure compressor 104. The highly compressed air is delivered to combustor 106. Airflow from combustor 106 drives rotating turbines 108 and 110 and exits gas turbine engine 100 through an exhaust system 118.

Figure 2:
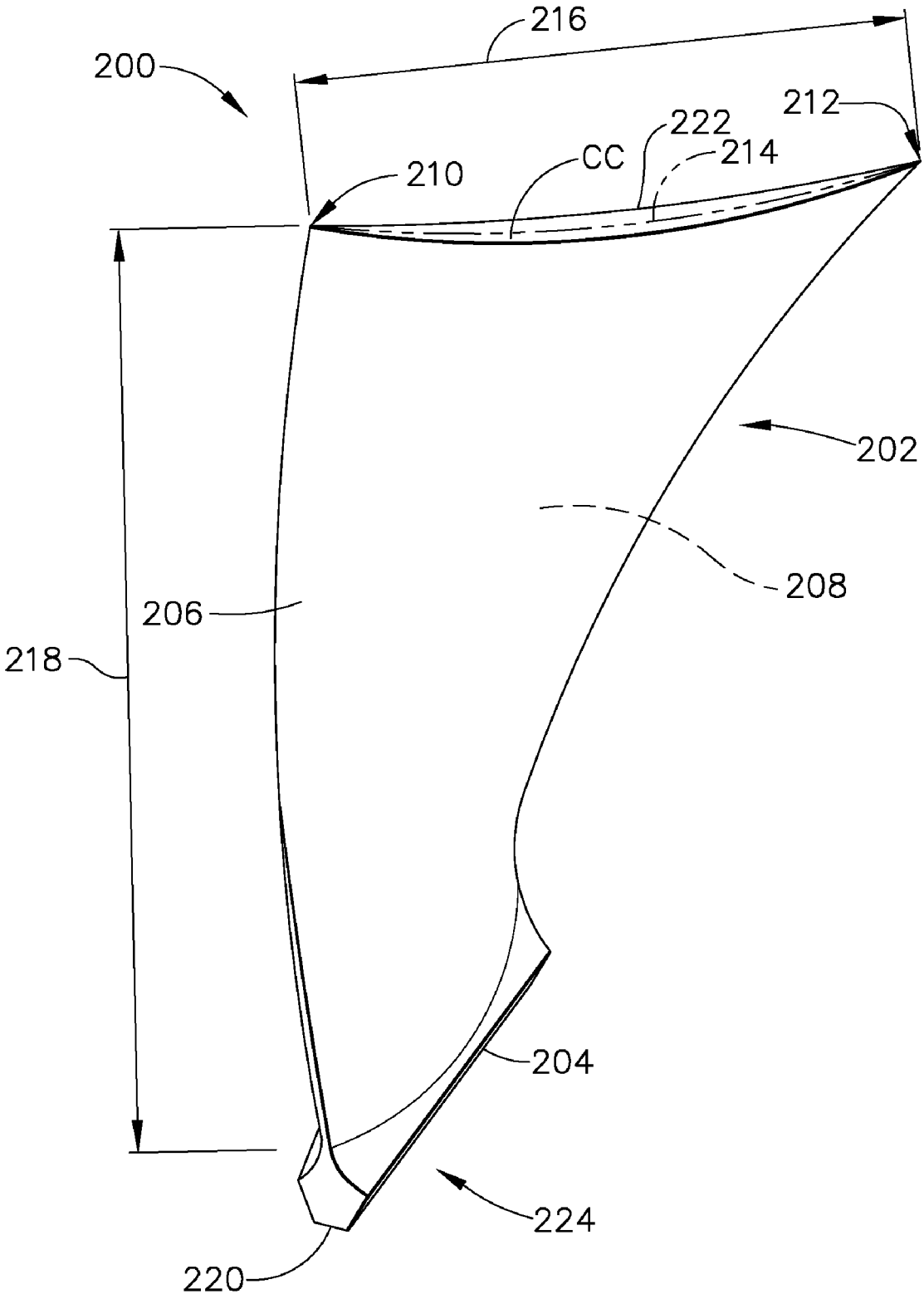
FIG. 2 is a perspective view of a rotor blade for use with the gas turbine engine shown in FIG. 1.

FIG. 2 is a perspective view of an exemplary rotor blade 200 for use with gas turbine engine 100 (shown in FIG. 1). In one embodiment, a plurality of rotor blades 200 form a high pressure compressor stage (not shown) of gas turbine engine 100. Each rotor blade 200 includes an airfoil 202 and an integral dovetail 204 for mounting airfoil 202 to a rotor disk (not shown). In one embodiment, blades 200 may extend radially outwardly from the disk such that a plurality of blades 200 form a blisk (not shown).

Airfoil 202 includes a first contoured sidewall 206 and a second contoured sidewall 208. First sidewall 206 is convex and defines a suction side of airfoil 202, and second sidewall 208 is concave and defines a pressure side of airfoil 202. Sidewalls 206 and 208 are joined at a leading edge 210 and at an axially-spaced trailing edge 212. A chord 214 of airfoil 202 includes a chord length 216 that represents the distance from leading edge 210 to trailing edge 212. More specifically, airfoil trailing edge 212 is spaced chordwise and downstream from airfoil leading edge 210. First and second sidewalls 206 and 208 extend radially outward in a span 218 from a root 220 to a tip 222. In the exemplary embodiment, blade 200 has a greater cross-sectional area CC proximate root 220 than proximate tip 222 to facilitate forming dovetail 224 for coupling blade 200 to the disk.

Figure 3:
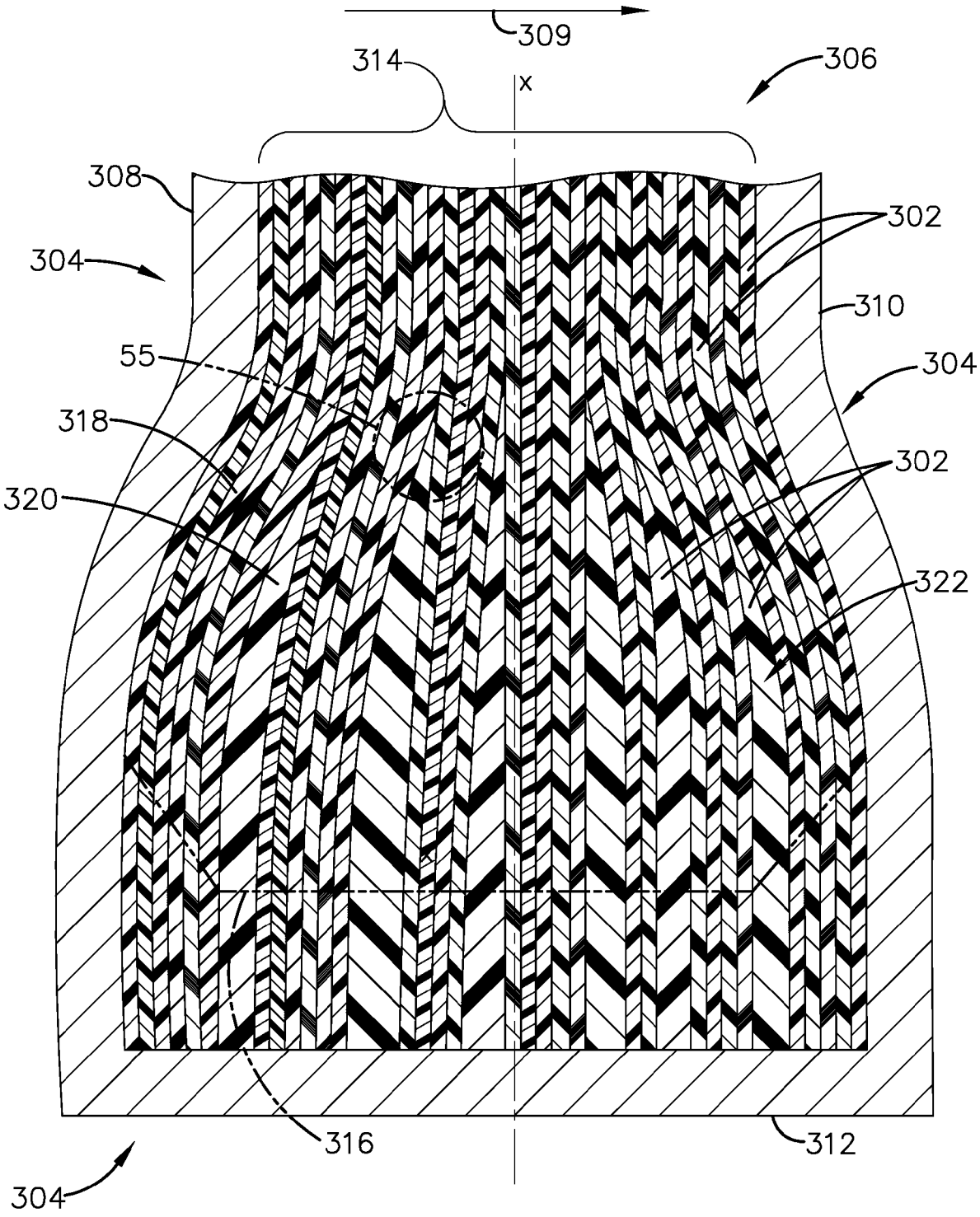
FIG. 3 is a cross-sectional view of the blade shown in FIG. 2.

FIG. 3 is a cross-sectional view of blade 200 proximate dovetail 224 during a manufacturing process of blade 200. In the exemplary embodiment, blade 200 is constructed by stacking plies 302 of composite material in a mold 304 and heating mold 304 (e.g., using a curing process) to form a structural core 306 of blade 200. Mold 304 is at least partially formed in the shape of blade 200. In the exemplary embodiment, mold 304 has two halves, namely a pressure half 308 and a suction half 310. Pressure half 308 and suction half 310 extend from a mold base portion 312 to a mold tip portion (not shown). An axis X runs through mold from base portion 312 to the tip portion. Pressure half 308 and suction half 310 are generally convex and may be coupled together to form mold 304. Mold 304 includes a hollow cavity (not shown) that is sized to accommodate a stack 314 of plies 302 therein.

In the exemplary embodiment, blade 200 is formed by initially layering plies 302 atop one another upwardly from pressure half 308 (hereinafter referred to as stacking plies 302 in an "upward direction 309") and coupling suction half 310 with pressure half 308 to at least partially encase stack 314 within the cavity of mold 304. Alternatively, stack 314 may be formed by layering plies 302 in any direction relative to mold 304 that enables blade 200 to function as described herein, such as, for example, by layering plies 302 atop one another upwardly from suction half 310. After encasing stack 314 within mold 304, mold 304 is subjected to a heating process that facilitates solidifying stack 314 into a structural core 306. After structural core 306 has been formed, structural core 306 is removed from mold 304 and is machined along a dovetail form 316 (e.g., using a grinding process) to create blade root 220 (shown in FIG. 2) and dovetail 224 (shown in FIG. 2).

Stack 314 includes plies 302 that extend substantially the length of span 218 (shown in FIG. 2) (i.e., extend from blade root 220 to blade tip 222 after structural core 306 has been machined at dovetail form 316) (hereinafter referred to as "structural plies 318"). Stack 314 also includes plies 302 that extend only partially the length of span 218 (i.e., extend only a portion of span 218 from blade root 220 after structural core 306 has been machined at dovetail form 316) (hereinafter referred to as "insert plies 320"). Insert plies 320 are layered in stack 314 to facilitate spreading structural plies 318 apart from one another proximate root 220 to facilitate forming dovetail 224. In one embodiment, insert plies 320 may be fabricated from a different material (e.g., a different composite material) than the material used to fabricate structural plies 318. Insert plies 320 are layered in stack 314 in bunches (hereinafter referred to as "insert packs 322"). In one embodiment, each insert pack 322 may include ten insert plies 320, for example. In another embodiment, insert pack 322 may include only one insert ply 320. Alternatively, insert pack 322 may include any number of insert plies 320 that enables blade 200 to function as described herein.

Figure 4:
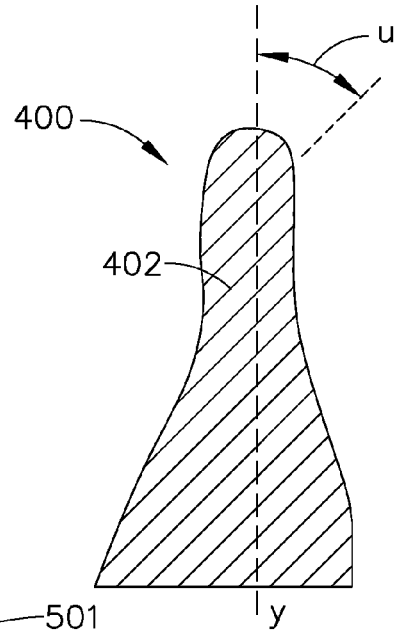
FIG. 4 is a plan view of an exemplary ply for use in manufacturing the blade shown in FIG. 3.

FIG. 4 is a plan view of an exemplary ply 302 (shown in FIG. 3). In the exemplary embodiment, ply 302 includes an arrangement 400 of composite fibers 402 (e.g., carbon fibers, ceramic matrix fibers, etc.). In one embodiment, composite fibers 402 are oriented in a direction relative to an axis Y of ply 302 (hereinafter referred to as a "unidirectional fiber orientation μ"). In another embodiment, arrangement 400 may include composite fibers that are woven together (i.e., oriented in different directions relative to axis Y). In the exemplary embodiment, arrangement 400 is impregnated with a resin material (not shown) such that, during the heating process, the resin material flows between plies 302 of stack 314 (shown in FIG. 3) to facilitate solidifying structural core 306. As used herein, the term "ply" refers to a segment of material having any contour and is not limited to substantially planar material segments as described herein.

Figure 5:
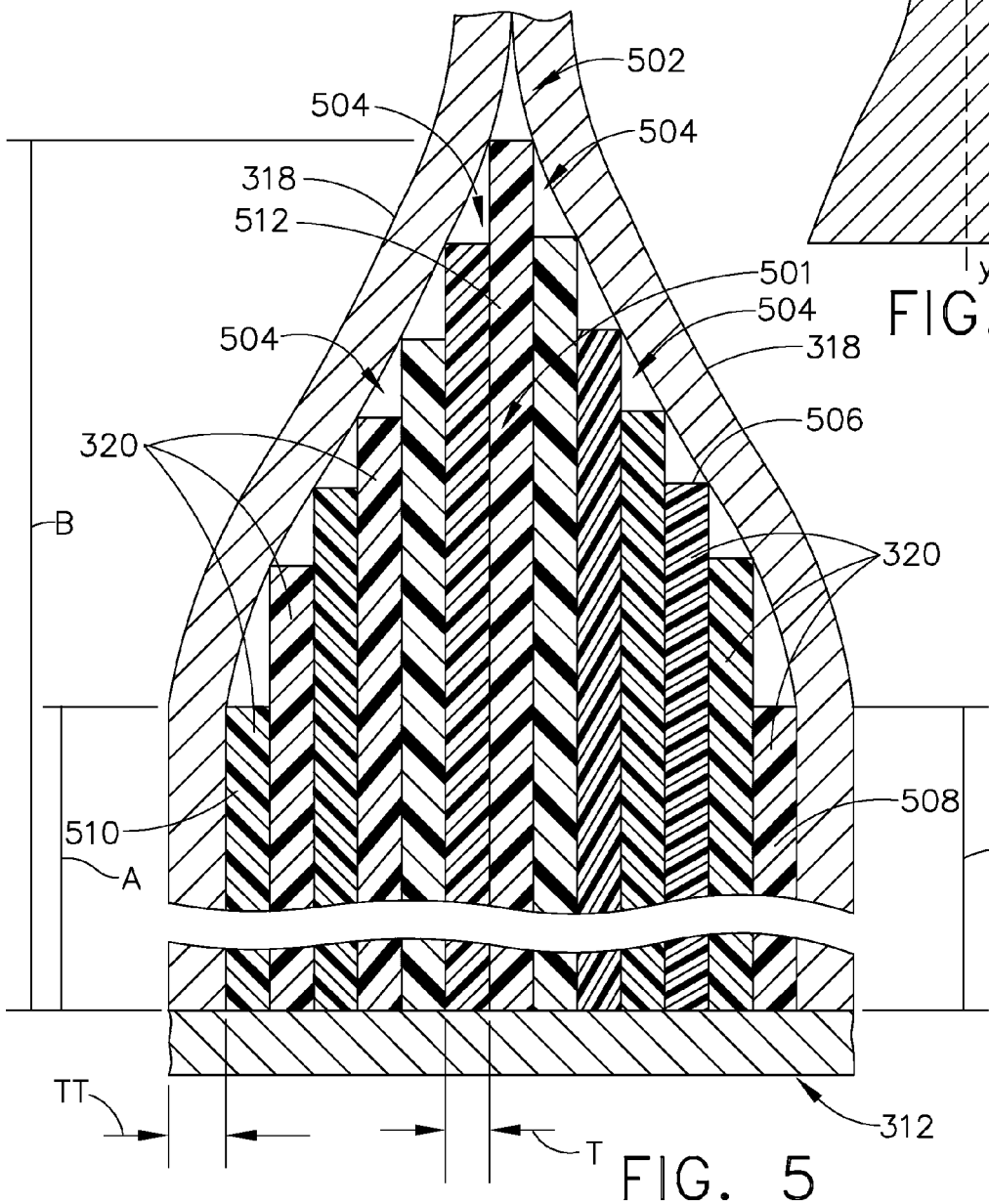
FIG. 5 is an enlarged cross-sectional view of a portion of the blade shown in FIG. 3.

FIG. 5 is an enlarged cross-sectional view of a portion 500 of stack 314 (shown in FIG. 3) taken along area 55. Each insert pack 322 (shown in FIG. 3) is formed with a tapered tip 501 that creates a divergence region 502 between adjacent structural plies 318 to facilitate reducing a formation of resin pockets 504 between insert pack 322 and adjacent structural plies 318 during the heating process. Tapered tip 501 is formed by staggering inner ends 506 of insert plies 320 as insert plies 320 are layered in stack 314. In the exemplary embodiment, tapered tip 501 has a top insert ply 508, a bottom insert ply 510, and at least one middle insert ply 512 positioned between top insert ply 508 and bottom insert ply 510. Bottom insert ply 510 extends into mold 304 a distance A from mold base portion 312, middle insert ply 512 extends into mold 304 a distance B from mold base portion 312, and top insert ply 508 extends into mold 304 a distance C from mold base portion 312. In the exemplary embodiment, distance B is greater than distance A and distance C, such that middle insert ply 512 extends further from mold base portion 312 than top insert ply 508 and bottom insert ply 510. In another embodiment, distance A is greater than distance B, and distance B is greater than distance C, such that bottom insert ply 510 extends further from mold base portion 312 than middle insert ply 512, and middle insert ply 512 extends further from mold base portion 312 than top insert ply 508. Alternatively, distance C is greater than distance B, and distance B is greater than distance A, such that top insert ply 508 extends further from mold base portion 312 than middle insert ply 512, and middle insert ply 512 extends a distance further from mold base portion 312 than bottom insert ply 510.

Each structural ply 318 has a thickness TT, and each insert ply 320 has a thickness T. In the exemplary embodiment, thickness TT is greater than thickness T to facilitate reducing a formation of resin pockets 504 during the heating process. In one embodiment, thickness TT is twice as thick as thickness T. For example, thickness TT may be approximately 0.01 inches, and thickness T may be approximately 0.005 inches.

Figure 6:
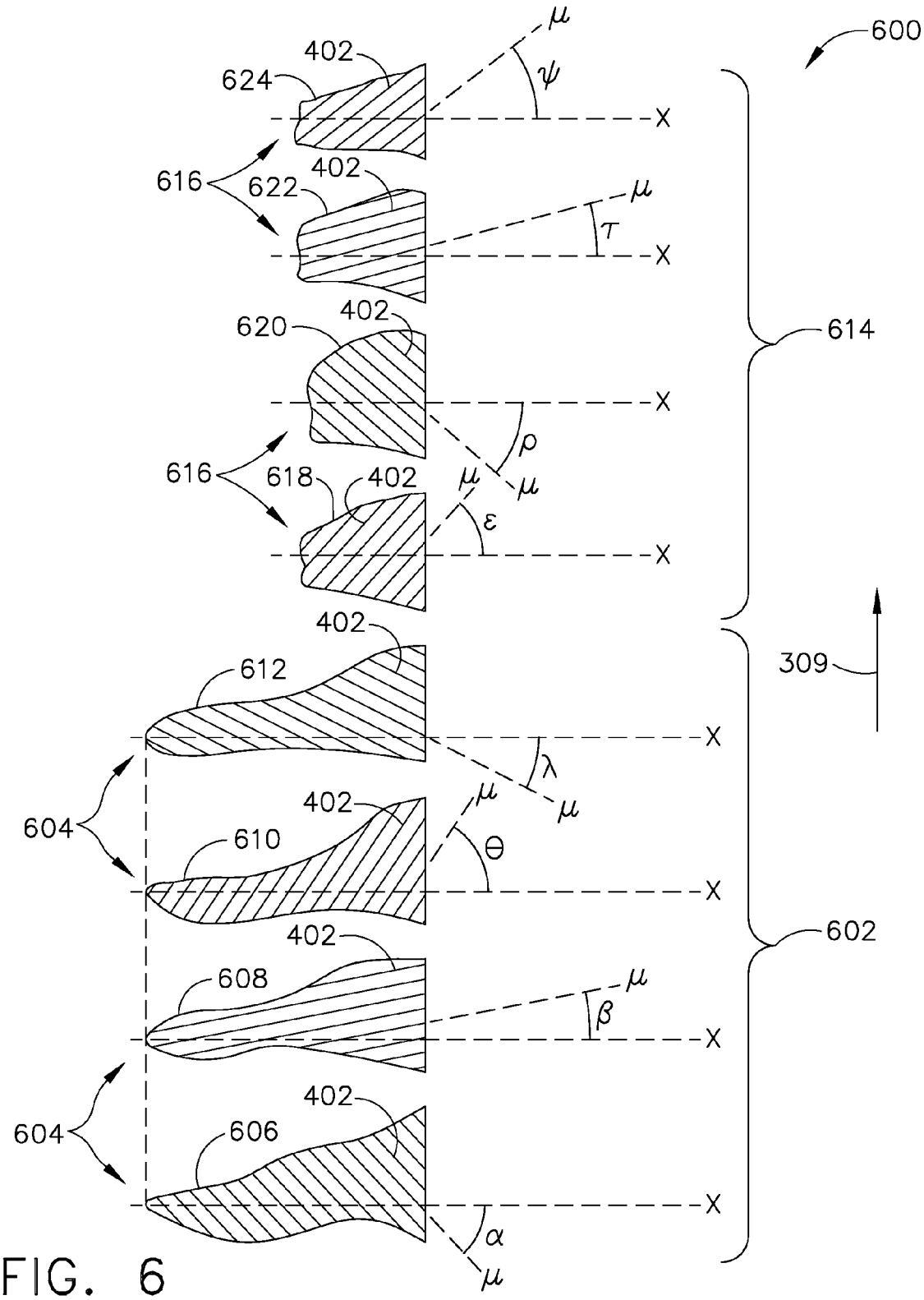
FIG. 6 is an exploded view of a portion of the blade shown in FIG. 3.

FIG. 6 is an exploded view of a portion 600 of stack 314 (shown in FIG. 3). In the exemplary embodiment, each ply 302 (shown in FIG. 3) is layered in stack 314 such that unidirectional fiber orientation μ is angled relative to axis X of mold 304 (shown in FIG. 3). Alternatively, at least one ply 302 may be layered in stack 314 such that unidirectional fiber orientation μ is parallel to axis X of mold 304.

To form stack 314, structural plies 318 (shown in FIG. 3) are layered in upward direction 309 in a predetermined directional sequence (hereinafter referred to as the "structural ply stacking sequence 602"). In the exemplary embodiment, structural ply stacking sequence 602 is repeated throughout stack 314. Alternatively, structural ply stacking sequence 602 may vary throughout stack 314. A set 604 of structural plies 318 forms structural ply stacking sequence 602. Set 604 may include any number of structural plies 318 that enables blade 200 to function as described herein. In the exemplary embodiment, set 604 includes a first structural ply 606, a second structural ply 608, a third structural ply 610, and a fourth structural ply 612, for example. First structural ply 606 is layered in stack 314 such that unidirectional orientation μ is positioned relative to axis X at an angle α. Second structural ply 608 is layered in stack 314 such that unidirectional orientation μ is positioned relative to axis X at an angle β. Third structural ply 610 is layered in stack 314 such that unidirectional orientation t is positioned relative to axis X at an angle ⊖. Fourth structural ply 612 is layered in stack 314 such that unidirectional orientation μ is positioned relative to axis X at an angle λ. Angles α, β, Θ, and λ may constitute any angular orientation that enables blade 200 to function as described herein. Angles α, β, Θ, and λ are different than one another in the exemplary embodiment. Alternatively, two or more of angles α, β, Θ, and λ are the same.

To form stack 314, insert plies 320 (shown in FIG. 3) are also layered in upward direction 309 in a predetermined directional sequence (hereinafter referred to as the "insert ply stacking sequence 614"). In the exemplary embodiment, insert ply stacking sequence 614 is repeated throughout stack 314. Alternatively, insert ply stacking sequence 614 may vary throughout stack 314. A set 616 of insert plies 320 forms insert ply stacking sequence 614. Set 616 may include any number of insert plies 320 that enables blade 200 to function as described herein. In the exemplary embodiment, set 616 includes a first insert ply 618, a second insert ply 620, a third insert ply 622, and a fourth insert ply 624, for example. First insert ply 618 is layered in stack 314 such that unidirectional orientation μ is positioned relative to axis X at an angle ϵ. Second insert ply 620 is layered in stack 314 such that unidirectional orientation μ is positioned relative to axis X at an angle ρ. Third insert ply 622 is layered in stack 314 such that unidirectional orientation μ is positioned relative to axis X at an angle τ. Fourth insert ply 624 is layered in stack 314 such that unidirectional orientation μ is positioned relative to axis X at an angle ψ. Angles α, β, Θ, and λ may be any angular orientation that enables blade 200 to function as described herein. In the exemplary embodiment, angles ϵ, ρ, τ, and ψ are different than one another. Alternatively, two or more of angles ϵ, ρ, τ, and ψ are the same. In the exemplary embodiment, insert ply stacking sequence 614 is different than structural ply stacking sequence 602. In one embodiment, at least one of the following is true: angle α is different than angle ϵ; angle β is different than angle ρ; angle Θ is different than angle τ; and angle λ is different than angle ψ.

The methods and systems described herein enable a blade to be manufactured in a manner that facilitates increasing a load carrying capacity of the blade. The methods and systems described herein further enable a blade to be manufactured to have a more uniform core structure that facilitates reducing the likelihood that the blade will crack or otherwise fail under thermal or mechanical stress applications. The methods and systems described herein further facilitate increasing a reliability of the blade and thus extending a useful life of the blade, while also reducing a cost associated with manufacturing the blade.

Exemplary embodiments of methods and systems for manufacturing blades are described above in detail. The methods and systems for manufacturing blades are not limited to the specific embodiments described herein, but rather, components of the methods and systems may be utilized independently and separately from other components described herein. For example, the methods and systems described herein may have other industrial and/or consumer applications and are not limited to practice with rotor blades as described herein. Rather, the present invention can be implemented and utilized in connection with many other industries.

While the invention has been described in terms of various specific embodiments, those skilled in the art will recognize that the invention can be practiced with modification within the spirit and scope of the claims.

What is claimed is:

1. A method of manufacturing a blade, said method comprising:

providing a plurality of first plies, each of the first plies sized to extend substantially the length of a span of the blade;

providing a plurality of second plies, each of the second plies sized to extend only partially the length of the span of the blade;

layering the plurality of first plies and the plurality of second plies such that the plurality of second plies is interspersed throughout the plurality of first plies to spread apart the plurality of first plies to facilitate increasing a cross-sectional area of the blade; and bonding the plurality of first plies to the plurality of second plies to facilitate forming a structural core of the blade.

2. A method in accordance with claim 1, wherein said layering the plurality of first plies and the plurality of second plies comprises interspersing the plurality of second plies in groups of adjacent second plies, each group having a tapered tip that facilitates reducing a resin pocket formation in the structural core of the blade.

3. A method in accordance with claim 2, wherein providing a plurality of first plies comprises providing each first ply with a first thickness, and wherein providing a plurality of second plies comprises providing each second ply with a second thickness, the first thickness being greater than the second thickness to facilitate reducing a resin pocket formation in the structural core of the blade.

4. A method in accordance with claim 1, wherein providing a plurality of first plies comprises providing each of the first plies with an arrangement of composite fibers oriented in the same direction relative to an axis of the first ply, and wherein providing a plurality of second plies comprises providing each of the second plies with an arrangement of composite fibers oriented in the same direction relative to an axis of the second ply.

5. A method in accordance with claim 4, wherein layering the plurality of first plies and the plurality of second plies comprises:

layering the plurality of first plies in sets, wherein each set of first plies has a first directional stacking sequence; and layering the plurality of second plies in sets, wherein each set of second plies has a second directional stacking sequence that is different than the first directional stacking sequence.

6. A method in accordance with claim 5, wherein layering the plurality of first plies in sets comprises layering each set of first plies such that at least two of the first plies in the set have composite fiber orientations that differ from one another relative to an axis of the mold, and wherein layering the plurality of second plies in sets comprises layering each set of second plies such that at least two of the second plies in the set have composite fiber orientations that differ from one another relative to an axis of the mold.

7. A method in accordance with claim 5, wherein layering the plurality of first plies in sets comprises repeating the first directional stacking sequence throughout the blade for every set of first plies, and wherein layering the plurality of second plies in sets comprises repeating the second directional stacking sequence throughout the blade for every set of second plies.

8. A system for manufacturing a blade, said system comprising:

a mold;

a plurality of first plies, each of said first plies sized to extend substantially the length of a span of the blade;

a plurality of second plies, each of said second plies sized to extend only partially the length of the span of the blade, said plurality of first plies layered with said plurality of second plies in said mold such that said plurality of second plies is interspersed throughout said plurality of first plies to spread apart said plurality of first plies to facilitate increasing a cross-sectional area of the blade.

9. A system in accordance with claim 8, wherein said plurality of second plies are interspersed throughout said plurality of first plies in groups of adjacent second plies, each group comprising a tapered tip that facilitates reducing a resin pocket formation in the blade.

10. A system in accordance with claim 9, wherein each of said first plies comprises a first thickness, each of said second plies comprising a second thickness, the first thickness being greater than the second thickness to facilitate reducing a resin pocket formation in the blade.

11. A system in accordance with claim 8, wherein each of said first plies comprises an arrangement of composite fibers oriented in the same direction relative to an axis of said first ply, each of said second plies comprising an arrangement of composite fibers oriented in the same direction relative to an axis of said second ply.

12. A system in accordance with claim 11, wherein said first plies are layered in sets, each set of first plies comprising a first directional stacking sequence, said second plies layered in sets, wherein each set of second plies comprises a second directional stacking sequence that is different than said first directional stacking sequence.

13. A system in accordance with claim 12, wherein each set of first plies comprises at least two first plies comprising composite fiber orientations that differ from one another relative to an axis of said mold, each set of second plies comprising at least two second plies comprising composite fiber orientations that differ from one another relative to an axis of said mold.

14. A system in accordance with claim 12, wherein said first directional stacking sequence is repeated throughout the blade for every set of first plies, and wherein said second directional stacking sequence is repeated throughout the blade for every set of second plies.

15. A blade comprising:

a plurality of first plies, each of said first plies sized to extend substantially the length of a span of said blade;

a plurality of second plies, each of said second plies sized to extend only partially the length of the span of said blade, said plurality of first plies layered with said plurality of second plies such that said plurality of second plies is interspersed throughout said plurality of first plies to spread apart said plurality of first plies to facilitate increasing a cross-sectional area of said blade, said plurality of first plies bonded to said plurality of second plies.

16. A blade in accordance with claim 15, wherein said plurality of second plies are interspersed throughout said plurality of first plies in groups of adjacent second plies, each group comprising a tapered tip.

17. A blade in accordance with claim 16, wherein each of said first plies comprises a first thickness, each of said second plies comprising a second thickness, the first thickness being greater than the second thickness.

18. A blade in accordance with claim 15, wherein each of said first plies comprises an arrangement of composite fibers oriented in the same direction relative to an axis of said first ply, each of said second plies comprising an arrangement of composite fibers oriented in the same direction relative to an axis of said second ply.

19. A blade in accordance with claim 18, wherein said first plies are layered in sets, each set of first plies comprising a first directional stacking sequence, said second plies layered in sets, wherein each set of second plies comprises a second directional stacking sequence that is different than said first directional stacking sequence.

20. A blade in accordance with claim 19, wherein said first directional stacking sequence is repeated throughout said blade for every set of first plies, and wherein said second directional stacking sequence is repeated throughout said blade for every set of second plies.

* * * * *